United States Patent [19]

Okuyama et al.

[11] Patent Number: 4,954,047

[45] Date of Patent: Sep. 4, 1990

[54] EVACUATION APPARATUS

[75] Inventors: Nobuhisa Okuyama; Shiuichi Goto, both of Chiba; Tsugio Enomoto, Kyoto, all of Japan

[73] Assignees: Toyo Engineering Corporation, Tokyo, Japan; Mikuni Jukogyo Co., Ltd., Osaka, Japan

[21] Appl. No.: 417,569

[22] Filed: Oct. 5, 1989

[30] Foreign Application Priority Data

Oct. 8, 1988 [JP] Japan ..... 63-252895

[51] Int. Cl.[5] ..... F04B 23/10

[52] U.S. Cl. ..... 417/203; 417/205; 417/267; 415/90

[58] Field of Search ..... 417/203, 205, 267; 415/90

[56] References Cited

U.S. PATENT DOCUMENTS

| | | | |
|---|---|---|---|
| 845,738 | 3/1907 | Alberger | 417/267 |
| 2,926,835 | 3/1960 | Lorenz | 417/205 X |
| 3,104,802 | 9/1963 | Eckberg | 417/205 X |
| 4,023,920 | 5/1977 | Bachler et al. | 415/90 X |
| 4,090,815 | 5/1978 | Nakamoto | 417/203 |
| 4,111,595 | 9/1978 | Becker et al. | 415/90 |
| 4,111,609 | 9/1978 | Braun | 417/267 X |
| 4,225,288 | 9/1980 | Mugele et al. | 417/203 X |
| 4,797,068 | 1/1989 | Hayakawa et al. | 417/205 X |
| 4,826,394 | 5/1989 | Lotz | 415/90 |
| 4,887,941 | 12/1989 | Crinquette et al. | 417/205 |

FOREIGN PATENT DOCUMENTS

| | | | |
|---|---|---|---|
| 0277896 | 12/1986 | Japan | 415/90 |

*Primary Examiner*—John Rivell

*Attorney, Agent, or Firm*—Flynn, Thiel, Boutell & Tanis

[57] ABSTRACT

An evacuation apparatus comprising (1) a reciprocating vacuum pump, the piston rings and piston shaft sealing material of which are made of a self-lubricating material at least on the surface and in which metallic bellows is or are used to seal between the piston shaft outside the cylinder and the outer face of the cylinder end wall, and (2) a turbomolecular pump in which a casing, stationary blades mounted on the casing, a rotor, and moving blades provided on the rotor are arranged coaxially, and in which the delivery opening of the reciprocating vacuum pump is open to the atmosphere and the suction opening of the turbomolecular pump is joined to an apparatus to be evacuated.

6 Claims, 4 Drawing Sheets

EVACUATION APPARATUS

BACKGROUND OF THE INVENTION

1. Field of the Invention

This invention relates to an evacuation apparatus useful for high vacuum evacuation systems which require cleanliness and high airtightness, such as, semiconductor manufacturing plants, evacuation equipment of radioactive gases occurring in nuclear power plants and particle accelerators, medical facilities and space engineering facilities.

2. Description of the Prior Art

In constructing an evacuation apparatus used in evacuation systems for semiconductor manufacturing plants and the like, it is customary to arrange a roughing pump on the atmospheric side of the system and a high vacuum pump on the vacuum side of the system. It is thus common to use two pumps in an evacuation system in which the operation is carried out under high vacuum. The conventional combination of two pumps generally employed for this purpose is one in which an oil-sealed rotary pump is installed on the atmospheric side of the system and a mechanical booster or a turbomolecular pump is used on the vacuum side of the system, depending on the operation pressures.

In the prior art, however, there still exist unsolved technical problems as described below. backdiff In producing a high vacuum, an oil-sealed rotary pump used as a roughing pump causes back-diffusion of the working oil to the apparatus being evacuated because the pump casing is filled with the oil, thus resulting in a reduction of the yield of satisfactory products produced in the apparatus under vacuum. Further, a process gas can react with the working oil to promote the degradation of the oil, or to cause fine particulates of reaction products produced by a reaction between the material processed under vacuum such as $SiO_2$ wafer and the process gas to migrate in the pump and trapped by the oil wetting the inside of the pump, and cause bad effects, such as damage of the pump. Since such fine particulates are dry, they would not be so trapped without such an oil, and would be delivered out of the pump. These problems have been pointed out for a long time by persons interested in semiconductor manufacturing plants and the like.

Even in the case of using a pump other than an oil-sealed rotary pump, as disclosed in Japanese Patent Laid-Open No. 291479/1987, by way of example, if the pump is a conventional rotary or reciprocating pump, it also involves the above-described problems to a greater or lesser degree because these types of pumps do not use a structure in which the oil-lubricated section and the vacuum side are completely isolated from each other, as is the case with the pump (I) of the invention as described below.

SUMMARY OF THE INVENTION

The invention overcomes the problems and disadvantages of the prior art by providing an improved evacuation apparatus.

An object of the invention is to provide a reliable evacuation apparatus which is free from oil diffusion to the vacuum side, capable of preventing pump troubles caused by oil deterioration and capable of safe and clean evacuation.

Additional objects and advantages of the invention will be set forth in the description which follows. Other objects and advantages will be obvious from the following description, or may be learned by practice of the invention. The objects and advantages of the invention will be realized and attained by means of the instrumentalities and combinations particularly pointed out in the appended claims.

To achieve the objects of the invention and in accordance with the purpose of the invention, as embodied and broadly described herein, the invention provides an evacuation apparatus comprising:

a reciprocating vacuum pump (I) comprising at least one reciprocating cylinder-and-piston pump set, each set having at least two suction-delivery chambers connected in series, each chamber being disposed between an inner face of the cylinder end wall and an end face of the piston, a suction nozzle and a delivery nozzle for each suction-delivery chamber, a suction valve for each suction nozzle, and a delivery valve for each delivery nozzle, the delivery nozzle of each suction-delivery chamber being connected to the suction nozzle of the succeeding suction-delivery chamber by a pipe, with the exception that the suction nozzle of the suction-delivery chamber which is located at one end of the series and the delivery nozzle of a suction-delivery chamber which is located at the other end of the series are open to the outside or to other parts of the system that are to be evacuated, and a piston rod joined to each piston, movable in a reciprocating manner through an end wall of the cylinder, and projecting to the outside of the cylinder, a piston ring provided in a circular peripheral groove in each piston, said piston ring comprising a self-lubricating material sealingly contacting the piston so that no liquid lubricant is needed to seal the piston, rod seal means for sealing the piston rod, said rod seal means comprising a self-lubricating material sealingly contacting the piston rod so that no liquid lubricant is needed to seal the piston rod, a metallic bellows sealingly mounted on and extending between an enlarged diameter part on the piston rod and the outer face of the cylinder end wall from which the piston rod projects, said bellows being located on the atmospheric side of the rod seal portion of the piston rod, and a turbomolecular pump (II) comprising a substantially cylindrical casing which is open at one axial end thereof and is closed at the other axial end thereof, said casing having coaxial therewith a suction opening of the same degree of diameter as the diameter of the casing and located at one axial end of the casing, said casing also having a delivery opening in the vicinity of the other end of the casing, a rotatable shaft provided coaxially in the casing, a drive motor coaxial with and drivingly connected to one end of the shaft on the side of the delivery opening, said drive motor being fixed onto the end of the casing near the delivery opening in the casing, a rotor coaxial with the motor and connected to the end of the rotatable shaft on the side of the suction opening, the rotor being equipped with a number of movable blades mounted coaxially with the rotor at axially spaced intervals, each blade being inclined in a common direction relative to an imaginary plane perpendicular to the rotatable shaft, the casing being equipped with a number of stationary blades on the inner surface thereof, which blades face the rotor and extend toward the axis of rotation of the rotor, the stationary blades being interdigitated with the movable blades and the lowermost stationary blade being located beneath the lowermost movable blade or between the lowermost and the second lowermost movable blades, each stationary blade being reversely inclined, relative to the movable blades, with respect to the imaginary plane perpendicular of the rotation shaft, the inclination of the movable blades being arranged in such a way that a fluid is driven from the suction opening to the delivery opening when the rotor is rotated by the rotation of the motor, the pump (I) having its delivery opening open to the atmosphere, its suction opening connected to the delivery opening of the pump (II) and the suction opening of the pump (II) being joined to an apparatus to be evacuated.

In the invention, a reciprocating oil-free pump (I) with its delivery opening communicating with the ambient atmosphere is combined in series with a turbomolecular pump (II) with its suction opening communicating with the apparatus or vessel to be evacuated (hereinafter referred to as the vacuum apparatus), whereby the vacuum apparatus is not contaminated or at most is only scarcely contaminated with oil and the deterioration of oil on the pump side by a process gas emanating from the vacuum apparatus is eliminated or is greatly reduced. The two-pump system, according to the invention, is capable of attaining a vacuum on the order of $10^{-8}$ torr.

The advantages of the invention will be described hereunder.

Adverse effects on products, caused by backdiffusion of oil from the pump to the vacuum apparatus, are eliminated completely or almost completely.

Maintenance work, such as replacement of the pump working oil, is eliminated or reduced.

The vacuum apparatus can be evacuated to a pressure in the range of from atmospheric pressure to $10^{-8}$ torr under a completely or substantially oil-free state.

On evacuating a gas apt to react with the oil, the degradation of the oil of the pump is prevented completely or substantially completely.

Evacuation of a process gas which cannot be permitted to leak to the ambient atmosphere, such as, radioactive gases and toxic gases, can be carried out without any fear of leakage of the process gas from the pump system.

BRIEF DESCRIPTION OF THE DRAWINGS

FIG. 1(*b*) is a plan view of the evacuation apparatus.

FIG. 1(*c*) is a side view of the evacuation apparatus.

DETAILED DESCRIPTION OF THE INVENTION

Figure 1B:
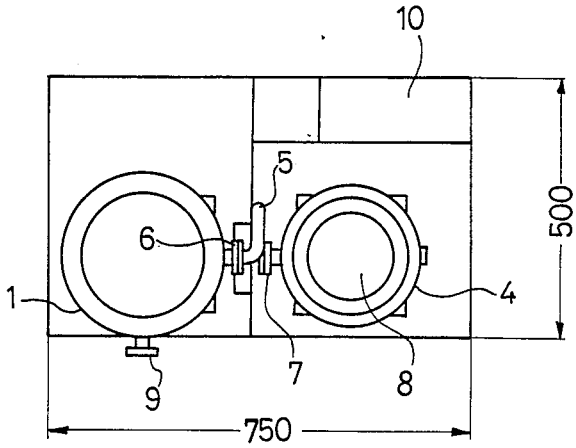
FIG. 1(*a*) is a schematic front view illustrating an evacuation apparatus of the invention.

In the reciprocating vacuum pump (I) arranged on the atmospheric side of the evacuation system as a roughing pump, the use of self-lubricating piston ring means disposed in groove means provided on the peripheral surface of each piston effects a lubricating action and sealing function between the cylinder and the sliding surface of the piston ring means without using any lubricating oil. The shaft seal is accomplished similarly by employing a sealant, including gland packing, made of a self-lubricating material. The leakage of trace amounts of oil through the shaft seal part is completely prevented by a dynamic bellows that is fixed by welding to a flange or an enlarged diameter section provided on the piston rod. The bellows is capable of withstanding a large number of repetitions of reciprocating motion of the piston rod.

A lubricating oil is fed to a drive motor of the pump or a crank shaft connected to the rotation shaft of the motor. There is, however, no possibility that the lubricating oil will migrate into the suction-delivery chambers of the reciprocating vacuum pump from the crank shaft side along the piston rod, owing to the sealing function of the aforesaid dynamic bellows. Therefore, this reciprocating vacuum pump is a completely oil-free vacuum pump.

The self-lubricating material is made, for example, of a polyfluoroethylene resin or a polyimide material.

Referring to rotary vacuum pumps of the screw type or roots type developed recently as so-called roughing dry pumps, it is structurally impossible to seal the shaft seal part by a dynamic bellows because of the rotation of the shaft so that the pumps have no means for completely preventing leakage of trace amounts of oil from the shaft seal part.

The suction and delivery valves of the pump (I) preferably are such that they are as large as and can cover (block) the suction and delivery orifices, which are holes made on a flat surface. One end of each of the suction and delivery valves is fixed on the flat surface that is a part of the inner or outer wall face of each suction-delivery chamber.

The material of which the suction and delivery valves is made should withstand the pressure difference thereacross without fatigue and should come in contact with the foregoing flat surface, owing to its elasticity, on closure of the valve when a process gas is not drawn in or discharged. Exemplary materials include thin steel plates having a thickness of about 0.3–0.1 mm, preferably 0.2–0.1 mm, and particularly 0.17–0.1 mm.

Regarding the steel, it is suitable to use austenitic stainless steels, especially those of the precipitation hardening type, more particularly AISI 633 equivalents such as AM-350 (Cr 16.5%, Ni 4.3%, etc.) manufactured by Allegheny Ludlum Steel Co., U.S.A.

The finish of the foregoing flat surfaces and the surfaces of the valves that are adapted to sealingly contact the flat surfaces should have a smoothness of not more than 6.3 μm, preferably not more than 0.8 μm (∇ or higher and ∇ or higher in terms of finish mark, respectively) in the difference between the highest and lowest levels defined in JIS B0601. These valves are one-way, nonreturn valves which check dynamic pressures generated by the reciprocating motion of the piston. The valves should be applied with buffing and the like to be the flat surfaces, since it is preferable that each valve comes in contact with the wall face with their mirror surfaces facing each other.

Figure 2:
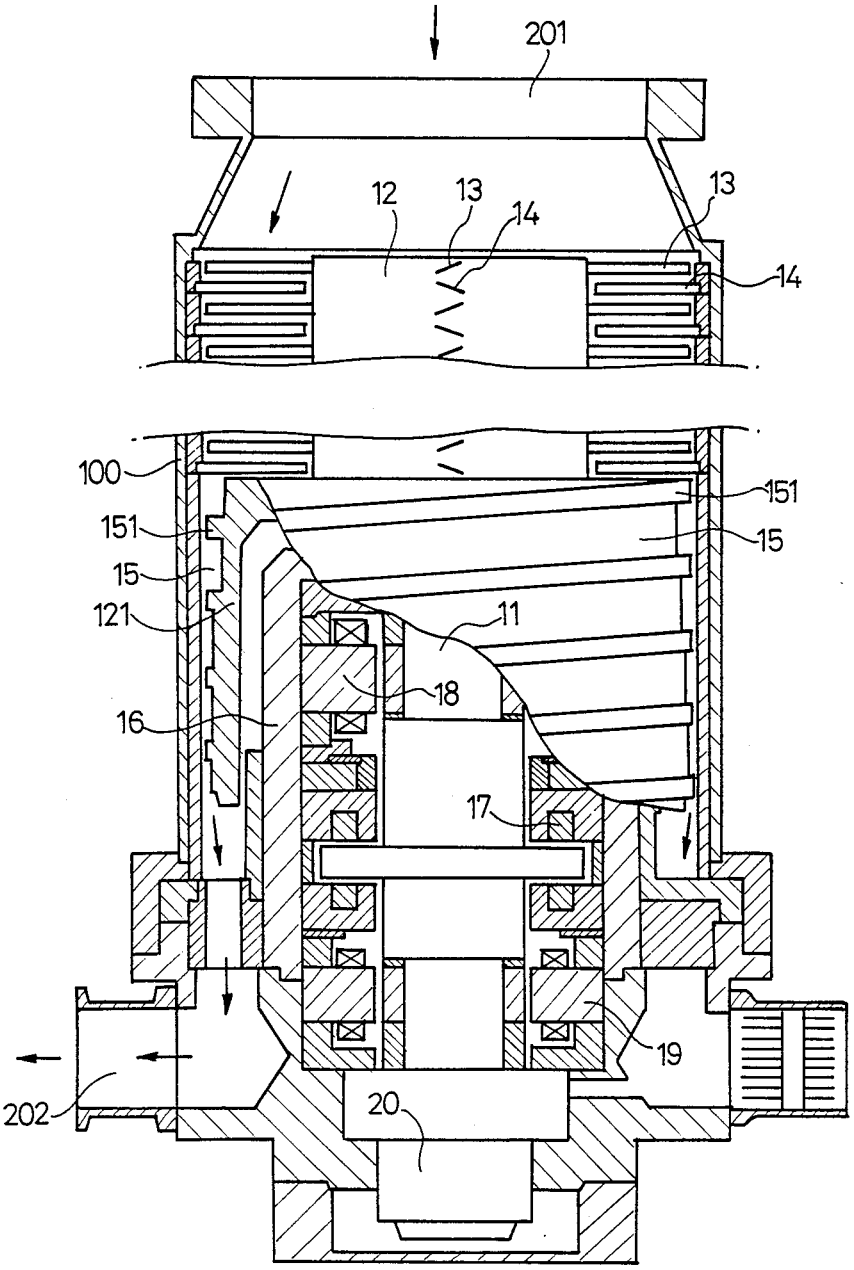
FIG. 2 is a partially broken-away schematic view illustrating a magnetic-bearing combination molecular pump.

The pump (II), typified by the combination molecular pump (IV), has no shaft seal part located outside the casing, as illustrated in FIG. 2.

In installations where dust and oil diffusion are permissible to some extent, fluoro-oil base lubricants and the like may be used with friction-type bearings, such as ball bearings as the bearings. However, the bearings are often required to be protected by purging with nitrogen, etc. This procedure is disadvantageous in that it requires a purge gas. In addition, it causes a loss of capacity corresponding to the amount of the purge gas. As a matter of course, support by magnetic bearings is adequate when a completely oil-free state is demanded.

Further, in accordance with the degree of vacuum required and the capacity of the pump (I), the pump (I) is combined with either the pump (II) or the pump (IV) to provide an apparatus of the invention.

The invention will be described hereunder by reference to a combination (or hybrid or compound) molecular pump using magnetic bearings.

The magnetic-bearing, combination, molecular pump has a bearing structure in which the rotatable shaft is floated by electromagnetic force acting in all directions, and it has no sliding surfaces or shaft seal parts. It is, hence, a completely oil-free vacuum pump with a self-contained motor, needing no lubricating oil.

The performances of the two pumps constituting the apparatus of the invention will be described next.

The reciprocating vacuum pump is capable of evacuating the vacuum apparatus from atmospheric pressure or below and commonly attains a vacuum of about $10^{-1}$ torr.

The compound molecular pump (IV) is incapable of start-up from atmospheric pressure and hence requires that its suction pressure be set at about 2 torr or below. Therefore, an auxiliary roughing pump is needed upon start-up from atmospheric pressure. The turbomolecular pump (II) requires a suction pressure of about several torr or less for start-up.

By arranging a reciprocating vacuum pump on the atmospheric side, as an auxiliary pump of a combination molecular pump, and joining the suction opening of the reciprocating vacuum pump with the delivery opening of the combination molecular pump as described above, it becomes possible first to start the reciprocating vacuum pump under atmospheric conditions and next start the combination molecular pump when the suction pressure is reduced to about 2 torr.

Embodiments of the invention will be described hereafter with reference to FIGS. 1(*a–b*) through 4.

Figure 1A:
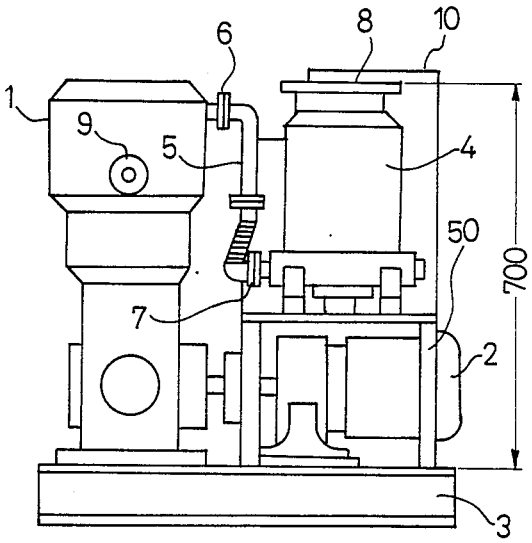
Figure 1C:
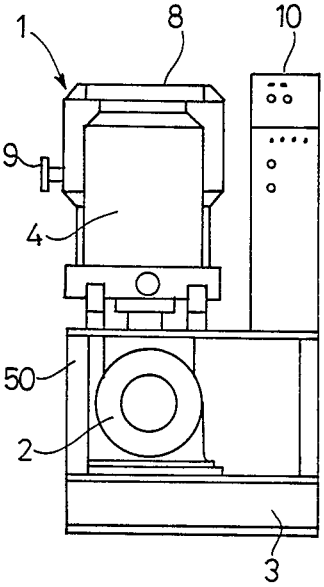

Referring to FIGS. 1(*a*), 1(*b*) and 1(*c*), a reciprocating vacuum pump 1 and a driving motor 2 therefor are fixed to and supported on a common base 3. A magnetic bearing, combination, molecular pump 4 is mounted on a pump support 50. Both pumps are connected in series with each other by a pipe 5 which extends between a suction opening 6 of the reciprocating vacuum pump and a delivery opening 7 of the magnetic bearing, combination, molecular pump 4. A vacuum apparatus (not shown) is joined to the suction opening 8 of the magnetic bearing, combination, molecular pump 4, whereby the gas in the vacuum apparatus is drawn through the suction opening 8 of the magnetic bearing, combination, molecular pump 4 and is discharged through the delivery opening 9 of the reciprocating vacuum pump 1 so that the vacuum apparatus is evacuated. The operation of the evacuation apparatus is controlled by means of a control panel 10.

FIG. 2 illustrates the construction of the magnetic bearing, combination, molecular pump 4. A rotor 12 is fixed on a shaft 11 in a casing 100 of the pump 4. A plurality of sets of movable blades 13 are mounted on the periphery of the rotor for rotation therewith and they are disposed in alternating interfitted relationship with sets of stationary blades 14, thus forming about 10 pairs of sets of interfitted rotatable and stationary blades. The rotor 12 has a lower, larger diameter section 121, which section has an external, rectangular, thread groove formed by a helical ridge 151. The ridge 151 extends through several turns around the axis of the shaft 11. The interior of the large diameter section 121 is hollow to provide an internal cavity and, hence, the section 121 is lightweight. In addition, the shaft 11, its bearings, etc., are arranged in the cavity so as to reduce the volume of the complete pump. The peripheral surface of the large diameter section 121 can be of a cylindrical shape, as shown, or it can be of a conical shape in which the diameter of the section 121 is larger toward the delivery side of the pump. The section 121 composes what is called a thread groove molecular pump (II). The shaft 11 is supported in the thrust and radial directions in a floating state caused by the action of the electromagentic force of an upper radial bearing electromagnet 18 and a lower radial bearing electromagnet 19, between which there is provided a thrust bearing electromagnet 17 fixed onto the inner surface of a housing 16. The shaft 11 is rotated at a high speed by a motor 20 mounted around the lower end of the shaft 11. The pump 4 receives gas molecules through a suction opening 201 and discharges them through a delivery opening 202. Although the pump gives a maximum compression ratio of $1\times10^8$ in the case of air, it has an operational limitation in that it cannot be started due to excessive load unless the pressure at the delivery opening 202 is less than about 2 torr.

With respect to the movable blades 13 and stationary blades 14, FIG. 2 shows only those projecting from the rotor in the parallel and perpendicular directions to the drawing with latters being only as segmented lines indicating their slant, and thus others are omitted in the drawing.

Figure 3:
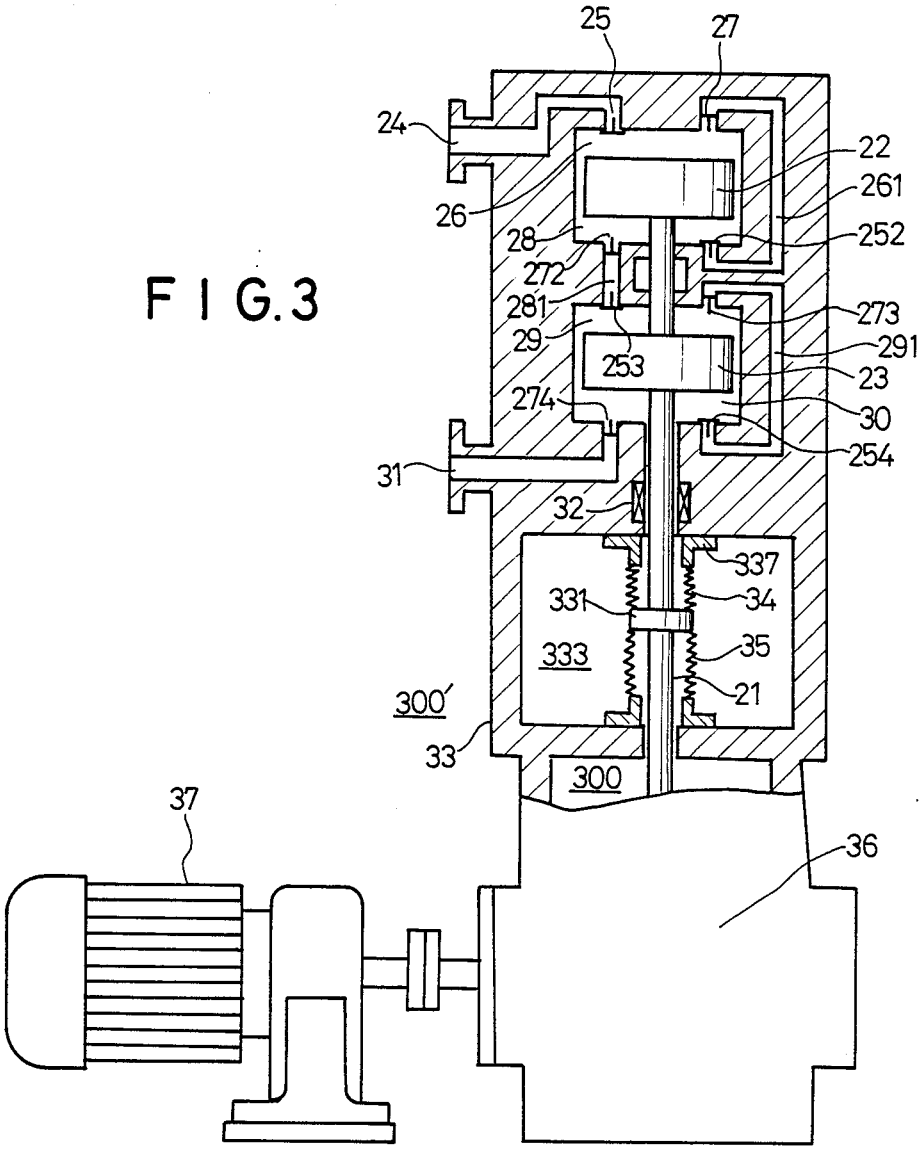
FIG. 3 is a partially borken-away schematic view illustrating a reciprocating vacuum pump.

FIG. 3 illustrates the details of the reciprocating vacuum pump 1. This pump is identical with reciprocating compressors in principle. Two pistons 22 and 23 are provided on the upper part of a piston rod 21. By the vertical motion of the pistons 22, 23, gas is drawn through an outer suction opening 24 via a suction or inlet valve 25 into a first stage cylinder suction-delivery chamber 26 where the gas is compressed, and from which it is discharged through a delivery or outlet valve 27. The three steps of suction, compression and delivery are also repeated simultaneously in a second stage cylinder suction-delivery chamber 28, a third stage cylinder suction-delivery chamber 29 and a fourth stage cylinder suction-delivery chamber 30. The compression ratio is increased by the total of four states of compression, and the gas is discharged through a delivery opening 31. The suction valves 25, etc., and the delivery valves 27, etc., are free-type, one-way, plate valves with a spring function and they open and close automatically in response to the pressure difference between the upstream and the downstream sides thereof. The valves 25 and 27 and the like are nonreturn valves for sucked and delivered gases. The piston rings and grooves of the cylinder are omitted in the drawing because they are conventional.

As regards the relation between the valves and the chambers, the valves 25, 252, 253 and 254 are suction (inlet) valves and belong to the chambers 26, 28, 29 and 30, respectively. The valves 27, 272, 273 and 274 are delivery (outlet) valves and belong to the chambers 26, 28, 29 and 30, respectively. The numerals 261, 281 and 291 signify respectively pipes or tubular passages for connecting the chambers 26 and 28, the chambers 28 and 29, and the chambers 29 and 30, respectively.

Figure 4:
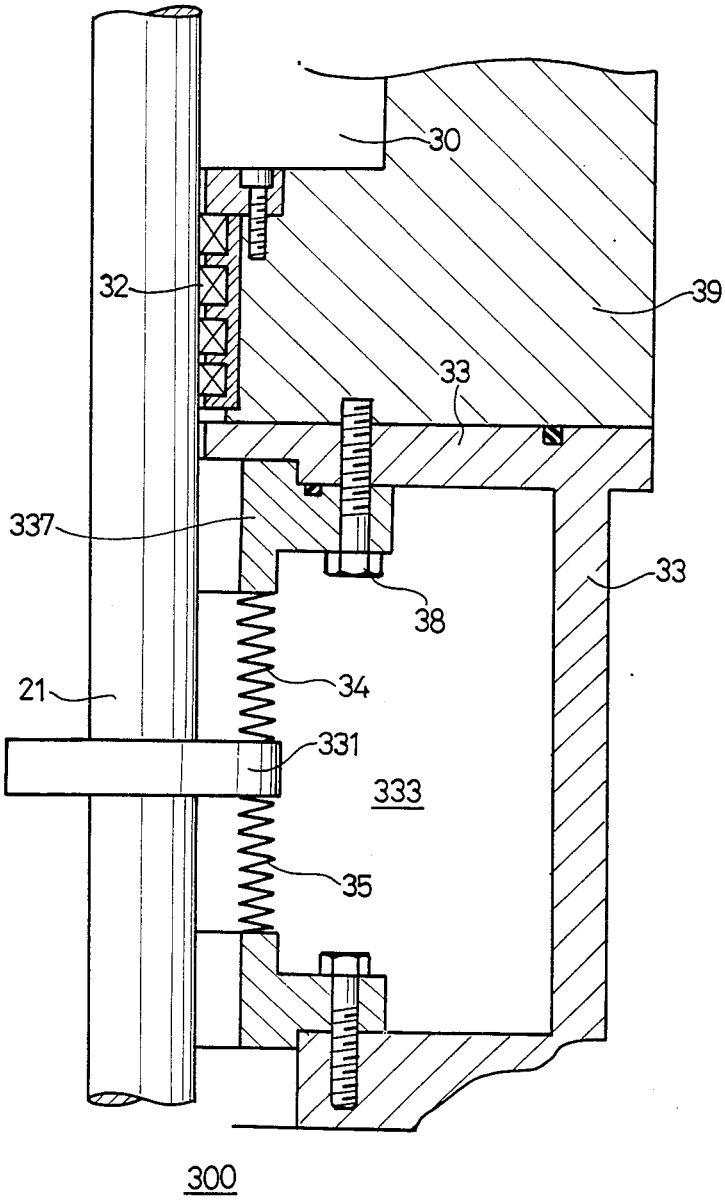
FIG. 4 is a schematic view illustrating the details of the seal part of the reciprocating vacuum pump.

The sealing of the piston rod 21 is effected by a self-lubricating gland packing 32. Further, a trace volume of gas leakage through the gland packing 32, due to the pressure difference between the chamber 30 and space 333, is completely sealed to the space 333 and eventually to spaces 300 and 300' by an upper dynamic bellows 34 which is fixed by welding between a flange 331 of the piston rod 21 and a bellows flange 337 situated on the outer face of the cylinder end will in an end piece 33 (FIG. 4). The piece separates the space 333 from the outer spaces 300 and 300'.

At the lower end of the piston rod 21, there is provided a crankcase 36 which houses the mechanism for converting the rotary motion of the shaft of a motor 37 to vertical motion of the piston 21. The crankcase 36 is filled with a lubricating oil. The upper dynamic bellows 34 is durable and has a long life. However, as a safety feature, in case of damage to it due to any cause, a lower dynamic bellows 35 is provided beneath it in this embodiment. The principal aim of this bellows 35 is to prevent the lubricating oil in the crankcase from migrating to the inside of the broken upper dynamic bellows 34 along the piston rod 21. However, the bellows 35 is not necessarily essential in the invention. It is also not essential, but is preferable from the standpoint of bellows protection and safety to leakage, to separate the space 333 from the outer space 300 or 300'. The bellows 35, the special and so-called doubly provided safety device, is essential in specific fields, like nuclear energy. It may, however, be appropriate not to add the bellows 35 in installations where some risk of leakage can be accepted.

FIG. 4 illustrates the seal part in more detail. The lower end of the upper dynamic bellows 34 is welded to the flange 331 of the piston rod 21, while its upper end is welded to the bellows flange 337. The bellows flange 337 is fixed to the cylinder end wall or cover 39 by a bolt 38 through the pice 33. Any leakage passing between the piston rod 21 and the gland packing 32 and between the fourth stage cylinder suction-delivery chamber 30 is completely sealed from the space 333 by the upper dynamic bellows 34 as described above. Penetration of the lubricating oil from the crankcase side is prevented doubly by the upper dynamic bellows 34 and the lower dynamic bellows 35 mounted similarly in such a manner that they face each other. They thus form a so-called double seal structure.

This example shows a design in which the power source of the pump (I), the power transmission means from the power source to the pump (I), means for connecting in an airtight fashion the delivery opening of the pump (II) with the suction opening of the pump (I), control means for controlling the operation of the pumps (I) and (II), electric power transmission means for communicating with the control means, the power source of the pump (I) and the motor of the pump (II) and electric power input means to the control means are assembled on a common base. This design requires only a small space and hence is excellent in compactness.

Operation Example 1

A pump (I) having specifications given in Table 1 and illustrated in FIG. 3 and a pump (IV) having specifications given in Table 2 and illustrated in FIG. 2 were assembled in series in the arrangement shown in FIG. 1, with the pump (I) disposed on the delivery side, thus providing an apparatus of the invention. A vacuum vessel having a volume of 100 l was evacuated from atmospheric pressure to a pressure 2 torr or below over a time period of about one minute by the pump (I). Then, the pump (IV) was started to effect a serial and simultaneous operation of the pumps (I) and (IV). The vacuum vessel was evacuated to $10^{-8}$ torr over a time period of about 1.5 hours and, while continuing the operation, a valve on the suction side of the pump (IV) was throttled. While maintaining the vacuum of the vacuum vessel at $10^{-4}$ torr, a chlorine derivative gas was admitted in the vacuum vessel and then passed through the evacuation apparatus for three hours at a rate of 1 SLM (standard liter/minute). Thereafter, the vacuum vessel was restored to atmospheric pressure.

The above cycle of operations was repeated 25 time's. After this repeated operation, the apparatus of the invention operated satisfactorily.

Operation Example 2

The operation was conducted in the same manner as described in Operation Example 1 except for the use, as the pump (IV), of a pump employing, in place of the magnetic bearings, nitrogen purge-type mechanical bearings employing a fluoro-oil base lubricant. Similar results to Operation Example 1 were obtained.

Comparative Example:

The operation was conducted in the same manner as described in Operation Example 1 except for the use of an oil-sealed rotary pump with the specifications given in Table 3, in place of the pump (I). In this case, the oil of the oil-sealed rotary pump was deteriorated after the aforesaid 25 cycles of operation, thereby requiring that the pump itself be replaced or overhauled.

In the above three examples, the amount of oil diffusion to the vacuum vessel was found to be the largest in Comparative Example, a little in Operation Example 2, and nil in Operation Example 1.

TABLE 1

| Specifications of Reciprocating Vacuum Pump | | |
|---|---|---|
| Rate of evacuation | | 600 l/min. |
| Number of revolution | | 450 rpm |
| Degree of vacuum attained | | $10^{-1}$ torr |
| Allowable back pressure | | 760 torr |
| Material | gas part (*) | SUS 304, Al |
| ditto | piston ring | Teflon |

TABLE 2

| Specification of Compound Molecular Pump | |
|---|---|
| Rate of evacuation | 600 l/sec. |
| Number of revolution | 2,400 rpm |
| Degree of vacuum attained (after baking) | $10^{-10}$ torr |
| Allowable back pressure | 2 torr |
| Material (*) | aluminum alloy |

TABLE 3

| Specification of Oil-Sealed Rotary Pump | |
|---|---|
| Rate of evacuation | 600 l/min. |
| Number of revolution | 1,700 rpm |
| Degree of vacuum attained | $10^{-2}$ torr |
| Allowable back pressure | 760 torr |
| Material pump | cast iron |
| Material vane | phenolic resin |
| Material O-ring | nitrile rubber |
| Oil | mineral oil |

(*) Principal parts are coated with "Clean S" manufactured by Showa Denko K.K.

The embodiments of the invention in which an exclusive property or privilege is claimed are defined as follows:

1. An evacuation apparatus, comprising: a reciprocating, cylinder-and-piston, vacuum pump and a turbomolecular pump connected in series with said reciprocating vacuum pump;

said reciprocating vacuum pump comprising a casing, said casing having therein at least one pump set composed of a non-lubricated cylinder having a reciprocating piston therein, said piston and said cylinder of each set having two suction-delivery chambers defined between the opposite end faces of said piston and the opposing internal end walls of said cylinder, said suction-delivery chambers being connected in series, a suction nozzle and a delivery nozzle for each suction-delivery chamber, a suction valve for each suction nozzle, a delivery valve for each delivery nozzle, the suction nozzle of the first suction-delivery chamber of the series being open for connection to the delivery opening of the turbomolecular pump, the delivery nozzle of the last suction-delivery chamber of the series being adapted to be connected to the ambient atmosphere or other receiver, each other delivery nozzle being connected to the suction nozzle of the next following suction-delivery chamber, an elongated, reciprocable piston rod connected to the piston of each pump set and extending therefrom through the end wall of the associated cylinder, said piston rod having a longitudinally extending portion located outside said casing, the longitudinally extending portion of said piston rod having a radially enlarged section opposed to the end wall of said casing, a metallic bellows fixed at one end thereof to said radially enlarged section of said piston rod and fixed at the other end thereof in sealing relationship to said casing, said bellows surrounding said piston rod for sealing the space outside said bellows from the space inside the casing;

said turbomolecular pump comprising a substantially cylindrical housing having a suction opening at one axial end thereof, said suction opening having a diameter of the same order of magnitude as the diameter of said housing, said housing being closed at the other axial end thereof and having a delivery opening in the vicinity of the other axial end of said housing, a coaxial rotatable shaft in said housing, a coaxial drive motor mounted in said housing close to said delivery opening and connected to the adjacent end of said shaft, a rotor coaxial with said motor and connected to said shaft at the end thereof adjacent to said suction opening, a plurality of movable blades mounted on said rotor for rotation therewith, said movable blades extending radially outwardly with respect to said rotor, said movable blades being arranged to define a plurality of axially spaced-apart stages and each movable blade being inclined in a common direction relative to a plane perpendicular to the axis of rotation of said rotor, said housing having a plurality of stationary blades mounted thereon and extending radially inwardly therefrom, said stationary blades being arranged to define a plurality of axially spaced-apart stages with the stages of said movable and stationary blades being interdigitated with each other, each stationary blade being inclined in a common direction and reversely to the direction of inclination of said movable blades relative to a plane perpendicular to the axis of rotation of said rotor, the blade angles of said movable blades being arranged so that a gas is driven from the suction opening to the delivery opening when said rotor is rotated, the suction opening of said turbomolecular pump being connectible to the apparatus to be evacuated.

2. The evacuation apparatus according to claim 1, including a thread-groove, molecular pump associated with said turbomolecular pump, said thread-groove, molecular pump comprising a large diameter section of said rotor disposed between said blades and said delivery opening, the external diameter of said large diameter section being slightly smaller than the internal diameter of said housing, the outer surface of said large diameter section being a cylindrical surface or a conical surface, the diameter of which is progressively enlarged in a direction toward said delivery opening, a helical screw flight projecting from said large diameter section into close proximity to the internal surface of said housing whereby to provide a thread groove which is effective to move the fluid to the delivery opening when the rotor is rotated.

3. The evacuation apparatus according to claim 1, wherein said shaft of said turbomolecular pump is supported for rotation by contactless magnetic bearings.

4. The evacuation apparatus according to claim 2, wherein said shaft of said turbomolecular pump is supported for rotation by contactless magnetic bearings.

5. The evacuation apparatus according to claim 1, comprising a common base having supported thereon said pumps, a power source for said reciprocating vacuum pump, power transmission means connecting said power source to said reciprocating vacuum pump, control means for controlling operation of said pumps, and electric power transmission means for coupling said control means, said power source and the motor of said turbomolecular pump.

6. The evacuation apparatus according to claim 1, in which said reciprocating vacuum pump is a duplex pump, comprising at least two of said pumping sets, each of said pumping sets being a double-acting pump.

* * * * *